US011946271B2

(12) United States Patent
Shaffer et al.

(10) Patent No.: US 11,946,271 B2
(45) Date of Patent: Apr. 2, 2024

(54) UMBRELLA BASE

(71) Applicant: Patio Leash LLC, Vonore, TN (US)

(72) Inventors: Robert William Shaffer, Vonore, TN (US); Christie L. Shaffer, Vonore, TN (US)

(73) Assignee: Patio Leash LLC, Vonore, TN (US)

( * ) Notice: Subject to any disclaimer, the term of this patent is extended or adjusted under 35 U.S.C. 154(b) by 0 days.

(21) Appl. No.: 17/814,669

(22) Filed: Jul. 25, 2022

(65) Prior Publication Data

US 2023/0036000 A1 Feb. 2, 2023

Related U.S. Application Data

(60) Provisional application No. 63/203,556, filed on Jul. 27, 2021.

(51) Int. Cl.
*E04H 12/22* (2006.01)
*A45B 23/00* (2006.01)

(52) U.S. Cl.
CPC ..... *E04H 12/2238* (2013.01); *E04H 12/2269* (2013.01); *A45B 23/00* (2013.01); *A45B 2023/0012* (2013.01); *A45B 2200/1009* (2013.01)

(58) Field of Classification Search
CPC . E04H 12/2238; E04H 12/2269; A45B 23/00; A45B 2023/0012; A45B 2200/1009
USPC ..... 248/519
See application file for complete search history.

(56) References Cited

U.S. PATENT DOCUMENTS 5,354,031 A * 10/1994 Bilotti ..... E04H 12/2238 248/910
5,941,261 A * 8/1999 Kouvaras ..... A45B 25/22 135/23
6,305,659 B1 * 10/2001 Metelski ..... A61B 90/25 248/910
6,895,982 B1 * 5/2005 Shaw ..... E04H 12/2246 135/16
6,964,277 B2 * 11/2005 Naber ..... A45B 25/00 135/117

(Continued)

FOREIGN PATENT DOCUMENTS

EP 2851489 A2 3/2015
WO 2004/101915 A1 11/2004

(Continued)

*Primary Examiner* — Taylor Morris
(74) *Attorney, Agent, or Firm* — Merchant & Gould P.C.

(57) ABSTRACT

An umbrella base includes an elongated receiver and a weighted housing coupled to and at least partially surrounding the elongated receiver. The weighted housing includes a bottom surface configured to be placed directly on an underlying surface and an opposite top surface. A retention system is supported on the weighted housing. The retention system includes one or more retractable straps mounted to the weighted housing, and a fastener device coupled to a free end of each of the one or more retractable straps and configured to releasably attach to outdoor furniture. The fastener device is adapted to selectively extend outwards from the weighted housing via the one or more retractable straps so that when the fastener device is attached to the outdoor furniture the weighted housing weighs down the outdoor furniture.

13 Claims, 10 Drawing Sheets

(56) References Cited

U.S. PATENT DOCUMENTS

| | | | | |
|---|---|---|---|---|
| 7,069,939 | B1 * | 7/2006 | Conde | A45B 25/00 135/25.41 |
| 7,562,930 | B1 | 7/2009 | Rondeau | |
| 7,614,600 | B1 * | 11/2009 | Smith | G09F 23/00 248/910 |
| 7,789,459 | B1 | 9/2010 | Rodriguez et al. | |
| 8,656,937 | B1 | 2/2014 | Minasi et al. | |
| 8,919,722 | B2 * | 12/2014 | Ma | A45B 23/00 248/129 |
| 9,127,475 | B2 * | 9/2015 | LeAnna | E04H 12/2253 |
| 9,706,820 | B1 * | 7/2017 | Lopez | E04H 12/2223 |
| D817,631 | S | 5/2018 | Weng | |
| 9,974,369 | B1 * | 5/2018 | DePaolo | E04H 12/2246 |
| 10,017,955 | B2 * | 7/2018 | Ye | A45B 23/00 |
| 10,327,418 | B2 * | 6/2019 | Johnson | A45B 25/00 |
| 10,492,579 | B1 * | 12/2019 | Volin | A45B 23/00 |
| 10,609,994 | B2 * | 4/2020 | Vanderminden | E04H 15/28 |
| 10,653,218 | B1 | 5/2020 | Volin | |
| 2002/0036008 | A1 | 3/2002 | Hickam et al. | |
| 2002/0108645 | A1 * | 8/2002 | Beyer | A45B 25/18 135/117 |
| 2004/0056169 | A1 * | 3/2004 | Harbaugh | E04H 12/2246 248/910 |
| 2005/0199774 | A1 * | 9/2005 | Reese | A45B 23/00 248/910 |
| 2011/0079700 | A1 | 4/2011 | Hilderbrand | |
| 2014/0209132 | A1 * | 7/2014 | Landry | A45B 25/22 24/129 R |
| 2014/0227920 | A1 * | 8/2014 | Lovett | A45B 3/00 441/1 |
| 2016/0183702 | A1 | 6/2016 | Elze et al. | |
| 2016/0309896 | A1 * | 10/2016 | Jankulovich | A47B 91/08 |
| 2016/0369521 | A1 * | 12/2016 | Eldridge | A01K 97/10 |
| 2019/0037984 | A1 | 2/2019 | Lake | |
| 2019/0107246 | A1 | 4/2019 | Lindsay | |
| 2019/0360229 | A1 | 11/2019 | Vanderminden | |
| 2020/0208430 | A1 * | 7/2020 | LeAnna | E04H 12/2238 |
| 2020/0256080 | A1 | 8/2020 | North et al. | |
| 2022/0268049 | A1 * | 8/2022 | Frerich | A45B 23/00 |

FOREIGN PATENT DOCUMENTS

| | | | |
|---|---|---|---|
| WO | 2005/065279 | A2 | 7/2005 |
| WO | 2006/090295 | A2 | 8/2006 |
| WO | 2015/013342 | A1 | 1/2015 |

* cited by examiner

UMBRELLA BASE

CROSS-REFERENCE TO RELATED APPLICATIONS

This application claims priority to and the benefit of U.S. Provisional Patent Application No. 63/203,556, filed Jul. 27, 2021, which is hereby incorporated by reference in its entirety.

INTRODUCTION

Patio or outdoor furniture generally is exposed to moisture and harsh weather including wind. During windy conditions, it is desirable that the outdoor furniture be restricted or prevented from being moved or blown away by the wind. Some outdoor furniture is constructed from lightweight, but durable materials, such as aluminum, so that they are easy to move around and can withstand wear and tear. However, this type of outdoor furniture can be prone to being moved or blown away in windy conditions. Accordingly, improvements to patio or outdoor furniture are desired.

SUMMARY

In an aspect, the technology relates to an umbrella base including: an elongated receiver configured to at least partially receive an end of a pole of an umbrella, the elongated receiver defining a longitudinal axis; a weighted housing coupled to and at least partially surrounding the elongated receiver, the weighted housing including a bottom surface configured to be placed directly on an underlying surface and an opposite top surface, the bottom surface and the top surface spaced apart along the longitudinal axis; and a retention system supported on the weighted housing, the retention system including: one or more retractable straps mounted to the weighted housing; and a fastener device coupled to a free end of each of the one or more retractable straps and configured to releasably attach to outdoor furniture, wherein the fastener device is adapted to selectively extend outwards from the weighted housing via the one or more retractable straps so that when the fastener device is attached to the outdoor furniture the weighted housing weighs down the outdoor furniture.

In an example, the fastener device automatically retracts towards the weighted housing upon release from the outdoor furniture. In another example, the one or more retractable straps radially extend and retract relative to the longitudinal axis. In still another example, an interior cavity is formed at least partially within the weighted housing between the bottom surface and the top surface, the retention system is mounted at least partially within the interior cavity. In yet another example, the weighted housing further includes a side wall extending between the bottom surface and the top surface parallel to the longitudinal axis, and one or more slots are defined in the side wall such that the one or more retractable straps extend therethrough with the fastener device being positioned exterior of the weighted housing. In an example, the weighted housing includes a bottom body and a top body, the bottom body and the top body defining an interior cavity configured to hold the retention system.

In another example, the retention system is disposed proximate the top surface and offset from the bottom surface. In still another example, the fastener device is pivotable relative to the free end of each of the one or more retractable straps. In yet another example, the retention system includes a plurality of retractable straps retractably mounted to the weighted housing, the plurality of retractable straps circumferentially spaced around the longitudinal axis. In an example, the plurality of retractable straps are discrete from one another.

In another aspect, the technology relates to an umbrella base including: an elongated receiver configured to at least partially receive an end of a pole of an umbrella; a housing including: a bottom body defining a bottom surface configured to be placed directly on an underlying surface; a top body defining a top surface and a side wall, the side wall extending between the top and bottom surfaces at least partially over the bottom body; and an inner body received at least partially within an interior cavity formed by the bottom body and the top body; and a retention system coupled to the inner body, the retention system including a plurality of fastener devices positioned at least partially exterior of the side wall, the plurality of fastener devices adapted to selectively and retractably extend outwards from the side wall and configured to releasably attach to outdoor furniture.

In an example, the inner body has a bottom wall, the bottom wall dividing the interior cavity of the housing into a top cavity and a bottom cavity, the retention system disposed within the top cavity, and one or more weights are disposed within the bottom cavity. In another example, the one or more weights include at least one of sand, water, or weighted plates. In still another example, the bottom body includes one or more interior struts supporting the inner body within the bottom body. In yet another example, the retention system includes a plurality of retractable straps coupled to the corresponding fastener devices, the plurality of retractable straps having a case coupled to the inner body. In an example, each of the bottom body, the top body, and the inner body have slots allowing at least a portion of the retention system to extend through the side wall of the housing.

In another example, a collar is fixed to the bottom body, the collar threadably coupled to an end of the elongated receiver. In still another example, the retention system is disposed in a top half of the housing.

In another aspect, the technology relates to a method of assembling an umbrella base including: providing an elongated receiver configured to at least partially receive an end of a pole of an umbrella; forming a housing, the housing including a bottom body defining a bottom surface configured to be placed directly on an underlying surface, a top body defining a top surface and a side wall, and an inner body; providing a retention system including a plurality of fastener devices adapted to selectively and retractably extend; coupling the elongated receiver to the bottom body; coupling the retention system to the inner body; disposing the inner body within an interior cavity at least partially formed by the bottom body; and covering the bottom body with the top body such that the elongated receiver at least partially extends from the top surface of the top body and the plurality of fastener devices are at least partially disposed on an exterior of the side wall.

In an example, the method further includes disposing one or more weights between the inner body and the bottom body.

BRIEF DESCRIPTION OF THE DRAWINGS

The following drawing figures, which form a part of this application, are illustrative of described technology and are not mean to limit the scope of the invention as claimed in any manner, which scope shall be based on the claims appended hereto.

DETAILED DESCRIPTION

Various features as well as advantages that characterize the umbrella base described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings. It is to be understood that both the foregoing introduction and the following detailed description are exemplary and explanatory and are intended to provide further explanation of the invention as claimed.

Throughout this description, references to orientation (e.g., front(ward), rear(ward), top, bottom, back, right, left, upper, lower, etc.) of the umbrella base relate to its position when placed on an underlying surface and are used for ease of description and illustration only. No restriction is intended by use of the terms regardless of how the umbrella base is situated on its own.

The umbrella base described herein is used to support an umbrella (e.g., a patio umbrella) in its upright orientation and for typical outdoor use. Generally, the outdoor umbrella is accompanied with outdoor furniture that can undesirably blow away in the wind when not in use. As such, once the outdoor furniture is no longer in use and to reduce or prevent the furniture from blowing away in the wind, the umbrella base includes a plurality of fastener devices that can be extended from the umbrella base and attached to the adjacent outdoor furniture. By attaching the outdoor furniture to the umbrella base, the outdoor furniture is weighed down against the wind. The fastener devices can be used regardless of the umbrella being supported by the umbrella base. By utilizing the umbrella base as a hold down device, additional components of an outdoor furniture set are no longer needed and do not need to be separately stored when no longer in use. Additionally, the umbrella base can be moved and repositioned as required or desired.

Figure 1:
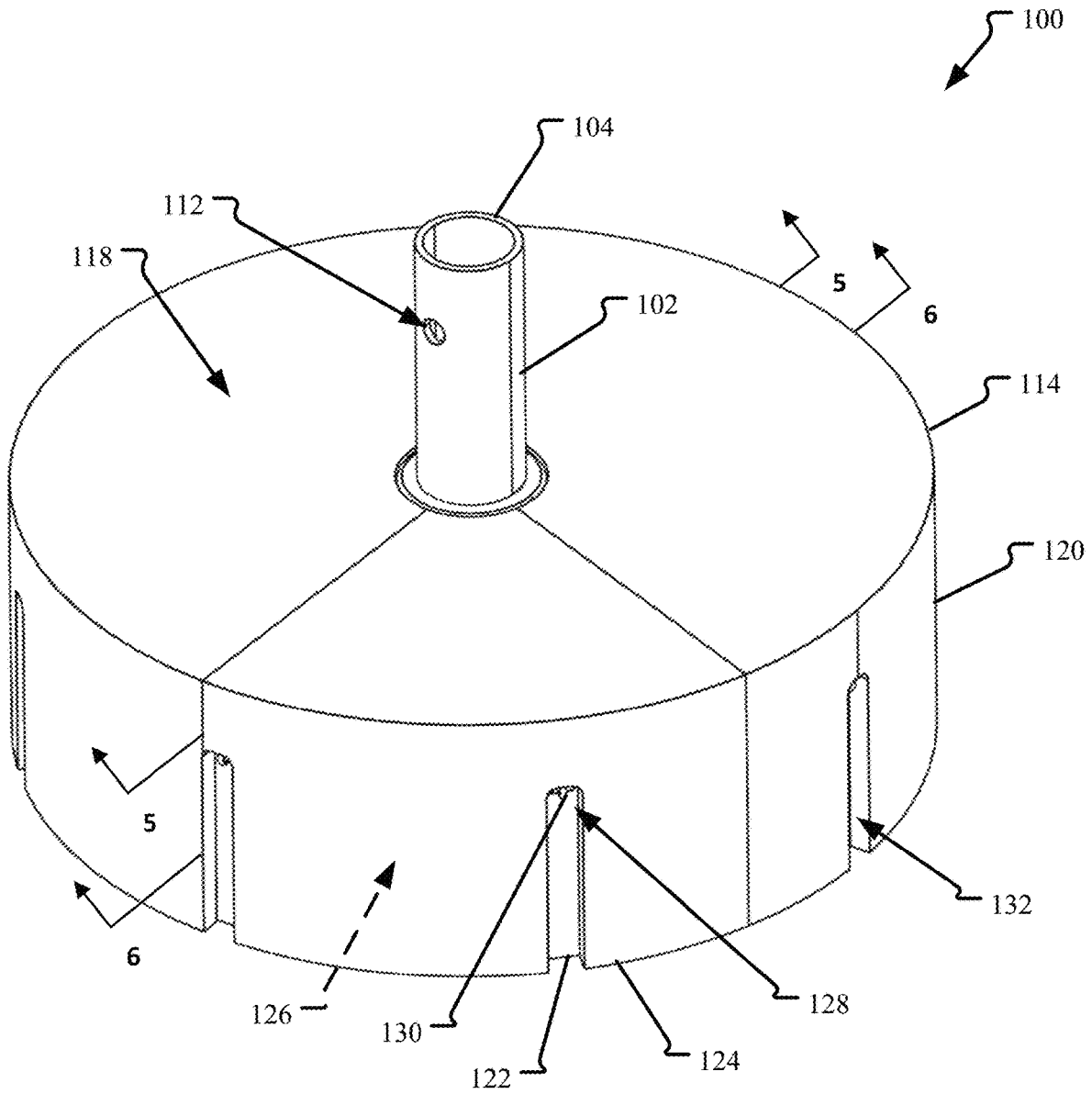
FIG. 1 is a top perspective view of an exemplary umbrella base.
Figure 2:
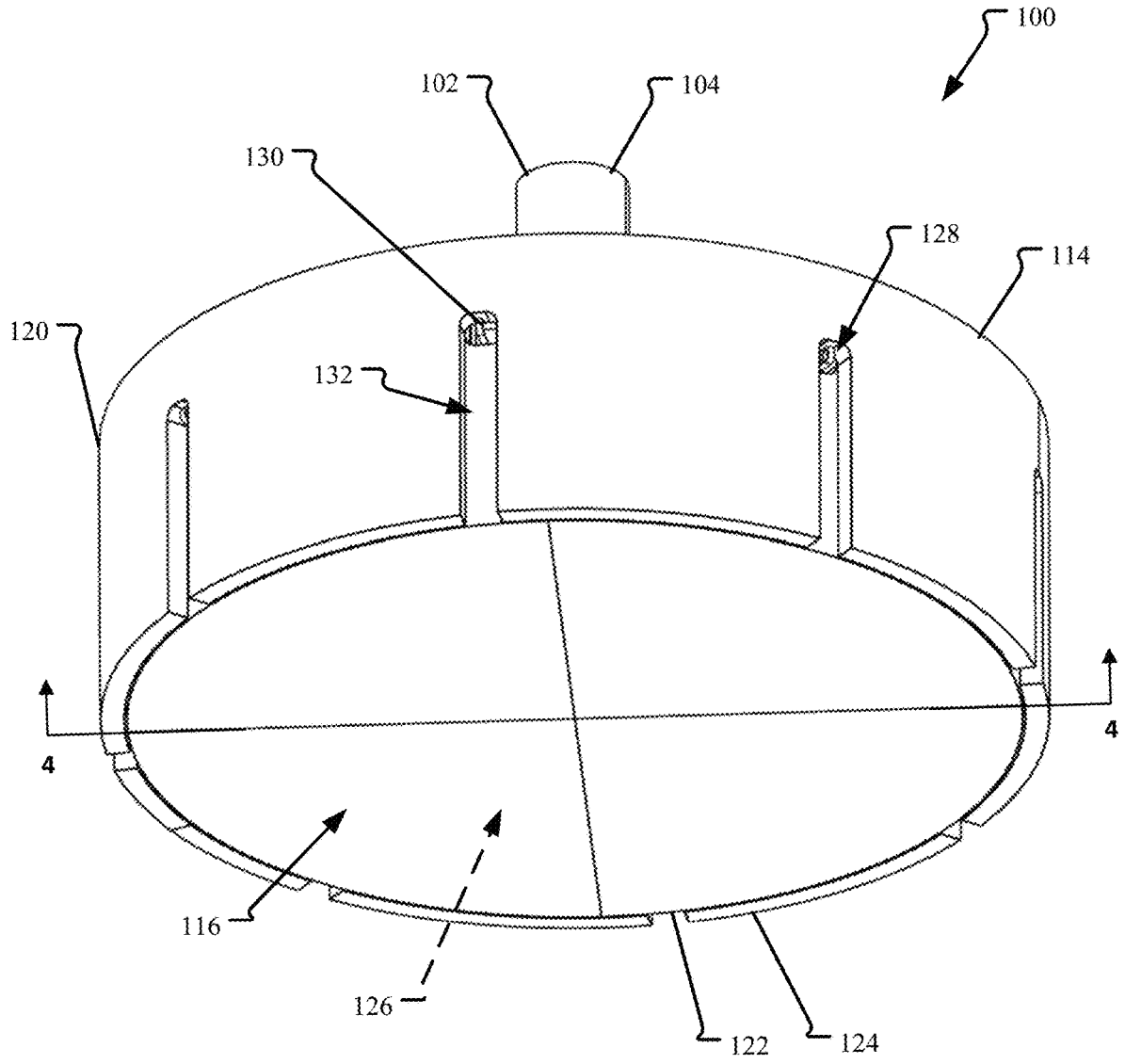
FIG. 2 is a bottom perspective view of the umbrella base.

FIG. 1 is a top perspective view of an exemplary umbrella base 100. FIG. 2 is a bottom perspective view of the umbrella base 100. Referring concurrently to FIGS. 1-2, the umbrella base 100 includes an elongated receiver 102 configured to at least partially receive an end of a pole of an umbrella (e.g., umbrella 202 shown in FIG. 9). As such, the umbrella is configured to cantilever from the umbrella base 100 such that a canopy of the umbrella is supported in the air without tipping over and users can be at least partially underneath. The elongated receiver 102 has a top end 104 and an opposite bottom end 106 (shown in FIG. 3). In the example, the elongated receiver 102 is formed as a tube that is open at both the top and bottom ends 104, 106. The bottom end 106 may include threads. In an aspect, the elongated receiver 102 may be about 12 inches long and 2 inches in diameter.

A securement device 108 (shown in FIG. 9) is disposed proximate the top end 104 and is utilized to secure the umbrella pole at least partially within the elongated receiver 102. In an aspect, the securement device 108 includes a threaded bolt and a knob 110 that are mounted at an aperture 112 defined within the elongated receiver 102. The knob 110 can be rotated so as to move the bolt within the aperture 112 and engage with the umbrella pole to secure the pole to the elongated receiver 102 and hold the umbrella upright.

Additionally, the umbrella base 100 includes a housing 114 coupled to and at least partially surrounding the elongated receiver 102. The housing 114 enables the umbrella to be supported in a substantially upright position without tipping over. For example, the housing 114 is weighted so as to support the umbrella. In operation, the umbrella can be inserted at least partially into the umbrella base 100 so that the umbrella is supported and the canopy can be used to cover and/or shade an area as required or desired. Typically, during windy conditions, the canopy of the umbrella is collapsed and/or the umbrella completely removed from the umbrella base 100 so that the umbrella is not moved by the wind. The umbrella base 100 may be weighted and has a low profile that is wind resistant so that the umbrella base 100 can be left out in windy conditions.

In the example, the housing 114 has a substantially cylindrical shape with a bottom surface 116, a top surface 118, and a side wall 120 extending between the top and bottom surfaces 116, 118. The bottom surface 116 is configured to be placed directly on an underlying surface such as a deck, patio, or the like so that the umbrella can be supported thereon. The top end 104 of the elongated receiver 102 extends upward from the top surface 118, and in an aspect, the elongated receiver 102 is centered within the housing 114. The housing 114 is enlarged relative to the elongated receiver 102 so as to restrict or prevent the umbrella from tipping over when supported by the umbrella base 100. In an aspect, the exterior dimensions of the housing 114 may have the side wall 120 being about 6 inches tall with about a 20 inch outer diameter.

The housing 114 includes a bottom body 122 that defines the bottom surface 116 and a top body 124 that defines the top surface 118 and the side wall 120. In the example, the bottom body 122 is configured to be received at least partially within the top body 124. The bottom body 122 and the top body 124 define an interior cavity 126.

In the example, the housing 114 is configured to be weighted so as to support the umbrella in a cantilever-type position. In an aspect, the interior cavity 126 of the housing 114 is configured to receive one or more weights to provide mass to the housing 114. For example, the interior cavity 126 can be filled with water, sand, and/or weighted plates in order to provide mass to the housing 114. In this example, the water, sand, and/or plates can be removed to make it easier to move and reposition the umbrella base 100. In another aspect, the housing 114 (e.g., the bottom and top bodies 122, 124) may be formed from a dense material (e.g., cast iron or the like) in order to add mass to the housing 114.

It should be appreciated, that FIGS. 1-2 show only one possible example of an umbrella base 100, and the umbrella base 100 can take on a variety of shapes and sizes while still enabling the umbrella base 100 to function as described herein. For example, the umbrella base 100 can include wheels (not shown) so that it is easier to move and position the housing 114. In another example, the umbrella base 100 can include one or more handles (not shown). In still another example, the umbrella base 100 can take the shape of an end table. In yet another example, the elongated receiver 102 may be off-center relative to the housing 114 so that the umbrella can be supported and placed against a wall or a railing as required or desired. In other examples, the housing 114 can be square-shaped, dome-shaped, cross-shaped, or the like.

The umbrella base 100 also includes a retention system 128 supported by the housing 114. In the example, the retention system 128 is disposed within the interior cavity 126. The retention system 128 includes one or more fastener devices 130 that are configured to selectively extend outward from the housing 114 and releasably attach to outdoor furniture. The fastener device 130 is any type of connection member that can releasably attach to outdoor furniture. As illustrated, the fastener device 130 includes a hook. In other examples, the fastener device can include a snap hook, an adjustable strap like a hook and loop fastener, an elastic member, or the like. The fastener device 130 is configured to attach to a portion of the outdoor furniture such as a leg of a table or chair, an arm rest of a chair, a frame of a table, or any other component of the outdoor furniture as required or desired. By coupling the housing 114 to the outdoor furniture, the outdoor furniture is weighed down by the housing 114, via the retention system 128, so that wind and other environmental conditions are restricted or prevented from moving and blowing away the outdoor furniture.

In the example, the retention system 128 includes a plurality of fastener devices 130 spaced circumferentially around the side wall 120. This configuration enables multiple pieces of outdoor furniture to be attached to the umbrella base 100. For example, multiple chairs, multiple tables, or both chairs and tables may be attached to the umbrella base 100 and weighed down to protect against windy conditions. In other examples, the umbrella base 100 may be disposed under a table with a portion of the umbrella pole extending from the elongated receiver 102 and through the table itself. As such, the retention system 128 can be used to attach to one or more chairs and/or the table so as to weigh down the outdoor furniture. One example of this configuration is described further below and in reference to FIG. 9.

The retention system 128 is disposed at least partially within the housing 114 so as to reduce the amount of components that project from the housing 114. In the example, a plurality of slots 132 are defined in the side wall 120 of the housing 114 that the fastener device 130 can extend through and project out from the housing 114. As such, the fastener devices 130 are positioned proximate the exterior of the side wall 120. The slots 132 can extend from the bottom surface 116 towards the top surface 118 on the side wall 120. The top end of the slots 132 terminate prior to the top surface 118 while extending all the way through the bottom surface 116. In other examples, the slots 132 can be fully defined by the side wall 120 and between the top and bottom surfaces 118, 116 as required or desired. In examples, not all slots 132 may receive a portion of the retention system 128.

The retention system 128 is disposed proximate the top surface 118 and offset from the underlying surface when the housing 114 is placed thereon. This location can maintain the operational functionality and the ornamental look of the housing 114 for supporting an umbrella. Additionally, by locating the fastener devices 130 above the underlying surface and towards the top surface 118, the fastener devices 130 can attach to the outdoor furniture at a position raised from the underlying surface so as to reduce or prevent the furniture from tipping over during a windy conditions. In other examples, the fastener devices 130 can extend from the top surface 118 as required or desired.

Figure 3:
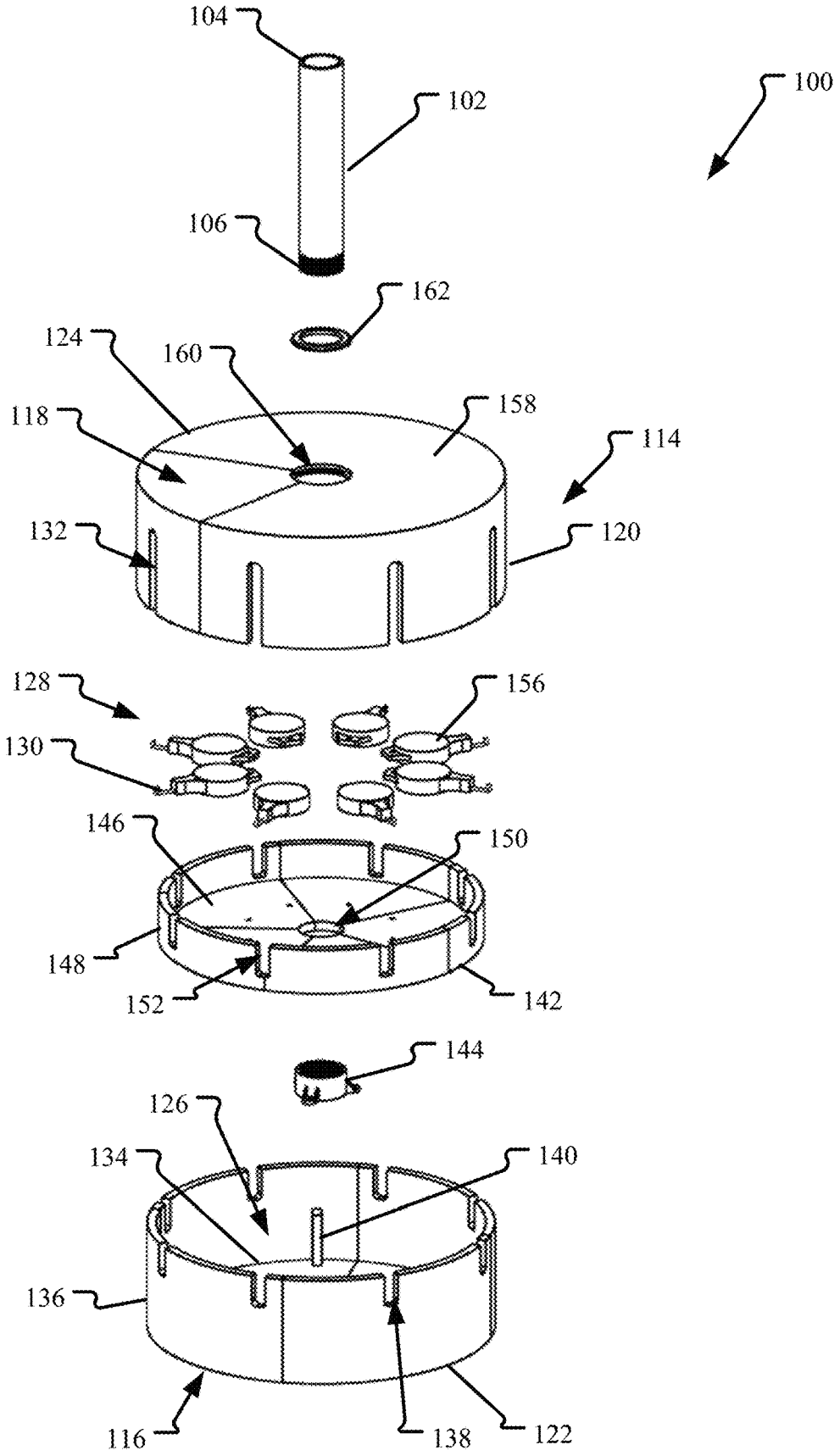
FIG. 3 is an exploded perspective view of the umbrella base.

FIG. 3 is an exploded perspective view of the umbrella base 100. The bottom body 122 has a bottom wall 134 that forms the bottom surface 116 of the housing 114 and a bottom side wall 136. At the top end of the bottom side wall 136, a plurality of slots 138 are defined and that enable the retention system 128 to be disposed within the housing 114 and allow the fastener devices 130 to extend and retract therefrom. One or more interior struts 140 are positioned within the bottom body 122 and against the bottom side wall 136. The interior struts 140 are configured to support an inner body 142 of the housing 114 within the bottom body 122.

A collar 144 is coupled to the bottom wall 134 and is threaded so that the bottom end 106 of the elongated receiver 102 is coupled to the bottom body 122 and extends upward therefrom.

The inner body 142 is configured to be receive at least partially within the interior cavity 126 defined within the bottom and top bodies 122, 124. The inner body 142 has an inner bottom wall 146 and an inner side wall 148. The inner bottom wall 146 defines an opening 150 for the elongated receiver 102 to extend through. At the top end of the inner side wall 148, a plurality of slots 152 are defined and that enable the retention system 128 to be disposed within the housing 114 and allow the fastener devices 130 to extend and retract therefrom. The inner bottom wall 146 is configured to support the retention system 128 in the interior cavity 126.

The retention system 128 is coupled to the inner body 142 which allows for the retention system 128 to be easily assembled and positioned within the housing 114. The retention system 128 include a plurality of retractable straps 154 (shown in FIG. 7) with each of the retractable straps 154 having the fastener device 130 coupled to a free end. The retractable straps 154 are housed within a case 156 that secures to the inner body 142 (e.g., via fasteners—not shown). The retractable straps 154 enable the fastener devices 130 to be positioned at least partially exterior of the side wall 120 of the top body 124 and selectively and retractably extend outwards so as to releasably attach to outdoor furniture. The retractable straps 154 also enable the fastener device 130 to be automatically retracted towards the housing 114 upon release from the outdoor furniture.

The top body 124 includes the side wall 120 which extends from a top wall 158 that forms the top surface 118 of the housing 114. The slots 132 extend upward from the bottom end of the side wall 120. An opening 160 is defined within the top wall 158 so that the top end 104 of the elongated receiver 102 can extend from the top surface 118. A gasket 162 can be used between the top body 124 and the elongated receiver 102 to provide an environmental seal at the top surface 118 and protect the retention system 128 below.

Figure 4:
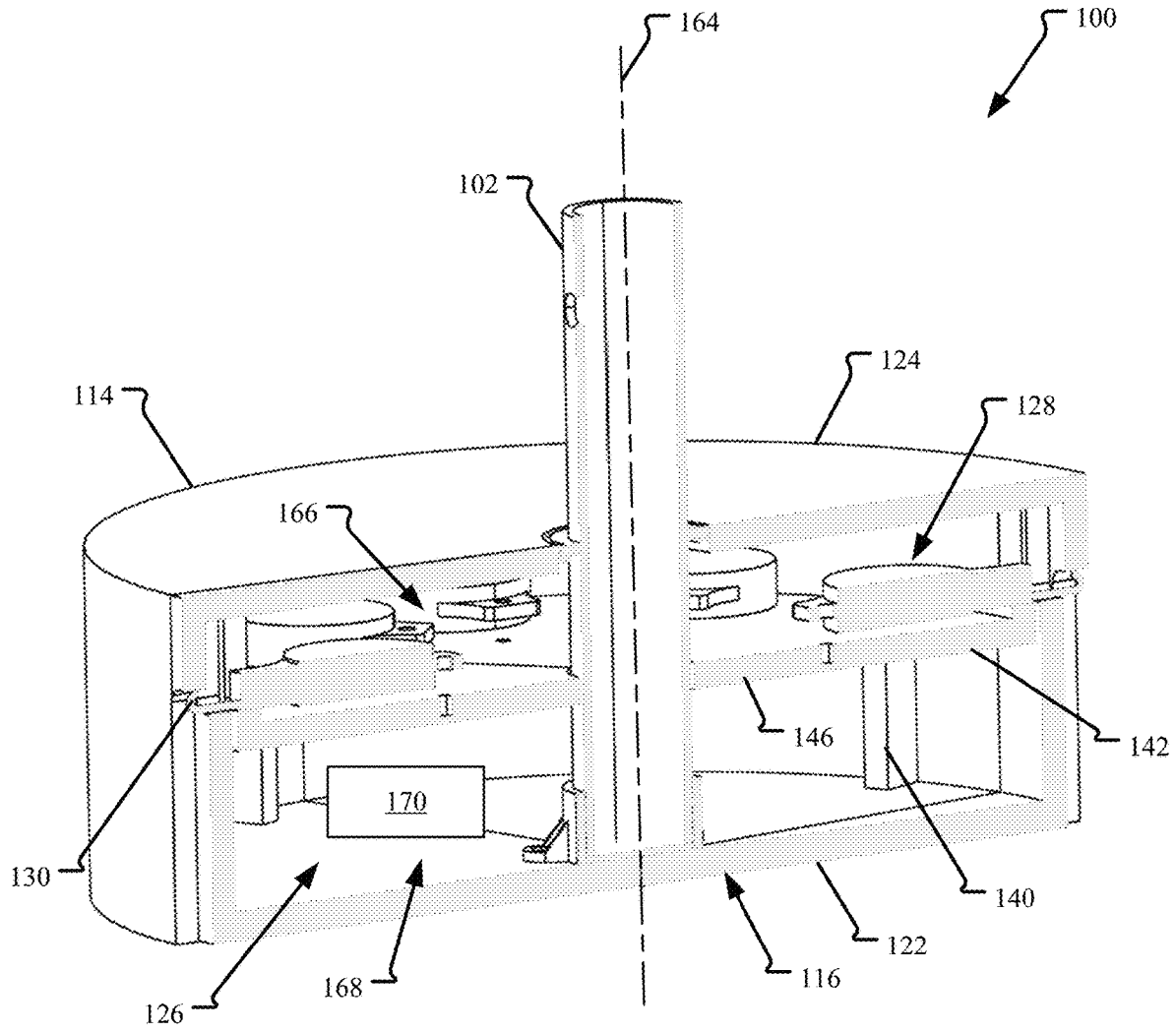
FIG. 4 is a cross-sectional perspective view of the umbrella base taken along line 4-4 shown in FIG. 2.

FIG. 4 is a cross-sectional perspective view of the umbrella base 100 taken along line 4-4 shown in FIG. 2.

Figure 5:
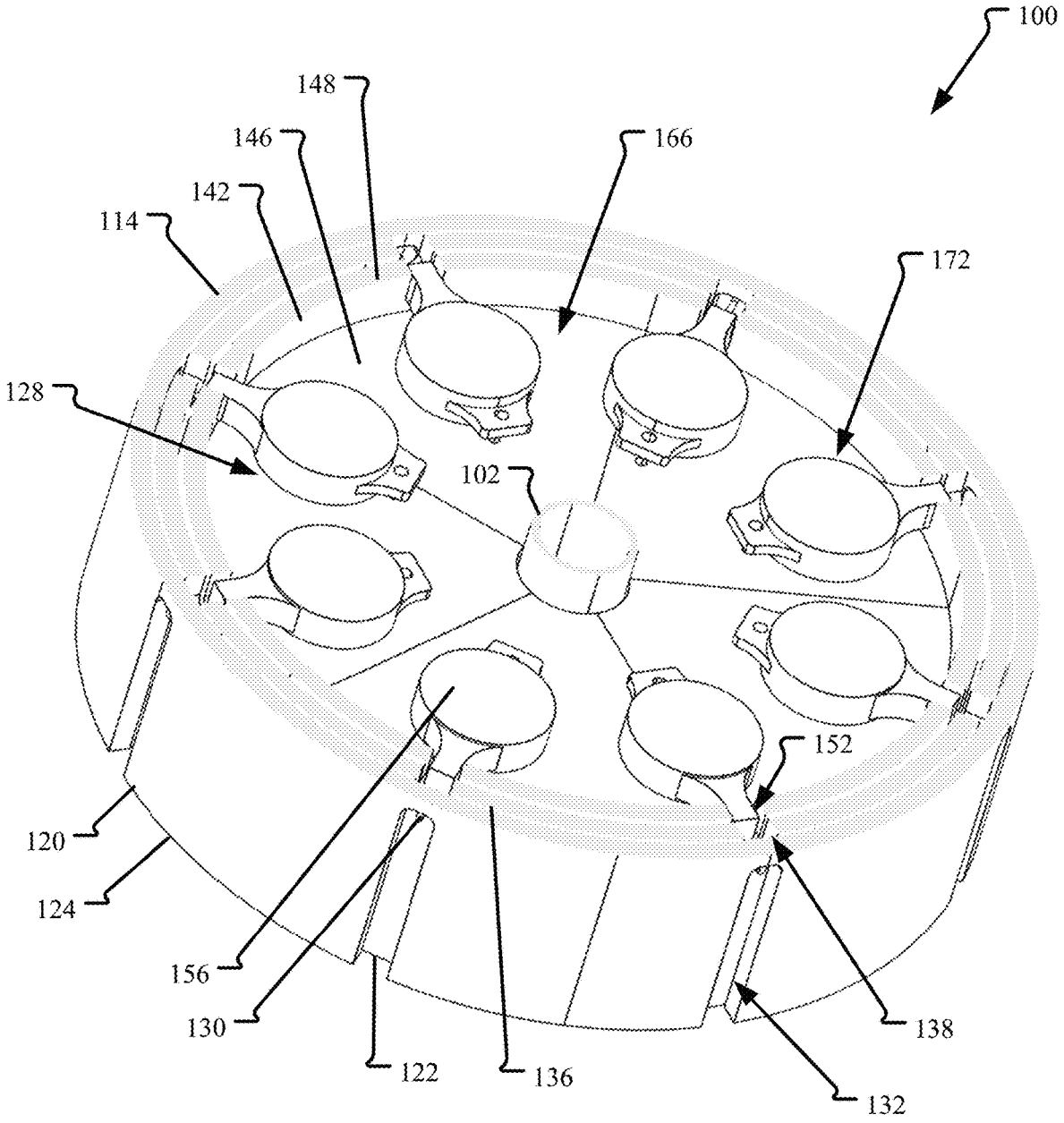
FIG. 5 is another cross-sectional perspective view of the umbrella base taken along line 5-5 shown in FIG. 1.
Figure 6:
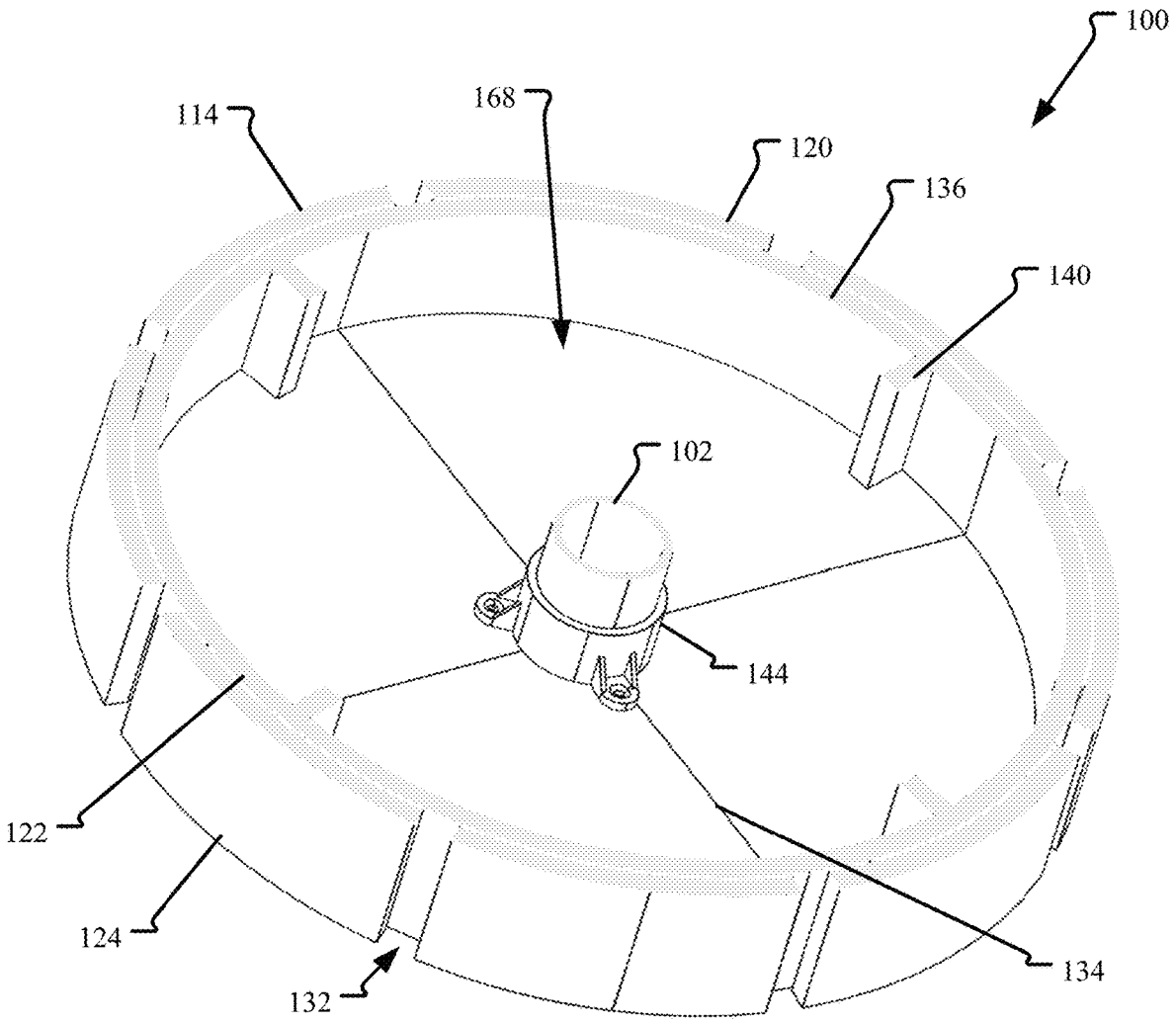
FIG. 6 is another cross-sectional perspective view of the umbrella base taken along line 6-6 shown in FIG. 1.

FIG. 5 is another cross-sectional perspective view of the umbrella base 100 taken along line 5-5 shown in FIG. 1. FIG. 6 is another cross-sectional perspective view of the umbrella base 100 taken along line 6-6 shown in FIG. 1. Starting first with FIG. 4, the housing 114 is formed from multiple components with the bottom body 122, the top body 124, and the inner body 142. The bottom and top bodies 122, 124 define the interior cavity 126. The elongated receiver 102 is supported by the housing 114 and defines a longitudinal axis 164 that extends in a substantially vertical direction when the umbrella base 100 is positioned on the underlying surface.

The inner body 142 is disposed within the interior cavity 126 such that the inner bottom wall 146 of the inner body 142 is raised above the bottom surface 116 of the housing 114. In the example, the inner body 142 is supported within the bottom body 122 with the interior struts 140. As such, the height of the interior struts 140 along the longitudinal axis 164 defines the position of the inner body 142 within the interior cavity 126. In an example, the height of the interior struts 140 is about 3 inches. The retention system 128 is mounted at least partially within the interior cavity 126 via the inner body 142. The inner body 142 divides the interior cavity 126 of the housing 114 into a top cavity 166 and a bottom cavity 168 relative to the longitudinal axis 164. The retention system 128 is disposed within the top cavity 166, and one or more weights 170 (illustrated schematically) are disposed within the bottom cavity 168. In the example, the top cavity 166 and the bottom cavity 168 are discrete from each other so as to separate the retention system 128 and the weights 170. The weights 170 may include sand, water, weighted plates, or the like.

In the example, the top cavity 166 has a smaller volume than bottom cavity 168 so that the umbrella base 100 can accommodate enough weight to weigh it down. In an aspect, the top cavity 166 is about ⅔ the volume of the bottom cavity 168. By positioning the retention system 128 above the bottom surface 116, the fastener devices 130 may be more easy to handle and allows for the connection to the outdoor furniture to occur higher up the leg/structure to reduce overturning moment from wind loads. In the example, the fastener devices 130 are positioned about 4⅜ inches above the bottom surface 116.

Turning next to FIG. 5, the top cavity 166 is illustrated. In the example, the top cavity 166 is disposed in the top half of the interior cavity 126 (shown in FIG. 4). As such, the retention system 128 disposed in the top half of the housing 114. The retention system 128 includes a plurality of discrete retention devices 172. Each retention device 172 includes the case 156 that is mounted to the inner bottom wall 146 of the inner body 142. The case 156 houses the retractable straps 154 (shown in FIG. 7) with the fastener device 130 coupled to the free end. The fastener device 130 is accessible from the exterior of the housing 114 even with the majority of the retention system 128 be positioned within the housing 114. The retractable strap 154 can be selectively pulled out from the housing 114 so that the fastener device 130 can extend and retract relative to the side wall 120 of the top body 124. In the example, the retractable strap 154 extends through the slot 132 defined in the side wall 120 of the top body 124, the slot 152 defined in the inner side wall 148 of the inner body 142, and the slot 138 defined in the bottom side wall 136 of the bottom body 122. As such, the fastener device 130 is positioned exterior of the top cavity 166 and the case 156 is positioned within the top cavity 166.

The retention devices 172 of the retention system 128 are circumferentially spaced around the longitudinal axis 164 (shown in FIG. 4) so that the retractable straps 154 radially extend and retract relative to the longitudinal axis 164. As illustrated, there are eight retention devices 172, however, any other number of retention devices 172 can be included as required or desired. Additionally, each retention device 172 is discrete and independent from each other. As such, each fastener device 130 can be independently used as required or desired. In other example, the retention devices 172 may be coupled together within the retention system 128 so that movement of opposing fastener devices 130 correspond to one another. In this example, the retention devices 172 may be integral with one another.

The retention system 128 includes a plurality of retractable straps 154 and the straps are discrete from one another. By using individual retractable straps 154, the retention system 128 can be modified as required or desired to the type and configuration of outdoor furniture that is to be attached. As illustrated, the retractable straps 154 are circumferentially spaced around the elongated receiver 102 and approximately 45° apart. This configuration can be used to attach to a plurality of different chairs that are around a table, with the umbrella base 100 below and in the middle of the table. In order to increase or decrease the number of outdoor furniture pieces that can be attached, the retractable straps 154 can be added or removed as required or desired. In the example, a total of eight retractable straps 154 are provided. Other numbers and spacings are also contemplated herein, for example, four retention device 172 and retractable straps 154 spaced 90° relative to each other. In an aspect, if fewer retention devices 172 are provided, the housing 114 may still included a greater number of slots 132, 138, 152 for modification later as required or desired.

The case 156 of the retention device 172 can include a reel that the retractable strap 154 is wound about and that enables the fastener device 130 to automatically retract towards the housing 114 upon release from the outdoor furniture. The case 156 can be attached to the inner bottom wall 146 of the inner body 142 via one or more fasteners (e.g., screws—not shown). In some examples, the reel can generate a retraction force on the retractable strap 154 such that tension is always applied on the strap when extended, and thus, tension is applied to the outdoor furniture when coupled thereto to assist in holding down the furniture in windy conditions. As such, when the fastener device 130 is released in an extended position, the retractable strap 154 automatically retracts into the case 156. In other examples, the reel can include a ratcheting mechanism so that the retractable strap 154 can be extended and have its extended length maintained. Once the retractable strap 154 is released from the ratcheting mechanism (e.g., via a pulling motion), the strap can automatically retract. It should be appreciated, that any other reel mechanism for the retractable strap 154 can be used as required or desired. By having the retention system 128 disposed within the top cavity 166, the umbrella base 100 can be used to retain outdoor furniture, and also store the retention system 128 out of the way when the umbrella is in use.

The bottom body 122, the top body 124, and the inner body 142 are oriented relative to the longitudinal axis 164 such that all of the slots 132, 138, and 152 align with each other and so that the retractable strap 154 can extend out of the housing 114. The slots in the bottom body 122 and the inner body 142 extend from the top of the side walls, while the slots in the top body 124 extend from the bottom of the side wall. This configuration enables for the retention system 128 to be accessible, but the top body 124 still covers the bottom cavity 168 (shown in FIG. 4).

The elongated receiver 102 extends through the inner bottom wall 146 of the inner body 142 such that the elongated receiver 102 extends through the top cavity 166 into the bottom cavity 168. In the example, the retention system 128 is spaced apart from the elongated receiver 102. In other examples, the retention system 128 can be additionally or alternatively coupled to the elongated receiver 102 as required or desired.

Turning next to FIG. 6, the bottom cavity 168 is illustrated. In the example, the bottom body 122 is positioned relative to the top body 124 so that the bottom cavity 168 is formed within the housing 114 to hold at least one weight. The weight can be water, sand, or the like. The weight may also be solid weight plates or the like. In an aspect, the mass of the weight can be adjustable so that more weight can be used when more outdoor furniture is connected to the umbrella base 100. The bottom cavity 168 is substantially devoid of structure so that the weight can be disposed therein. In examples, the water or sand may be held in bladders or tanks that are positioned within the bottom cavity 168. One or more retainers (not shown) may be provided within the bottom cavity 168 that hold retain the weight components when disposed therein.

The interior struts 140 are disposed along the perimeter of the bottom side wall 136 so as to reduce interference with the weights. The interior struts 140 may be circumferentially spaced around the elongated receiver 102. The elongated receiver 102 extends through the housing 114 and couples to the collar 144 mounted to the bottom wall 134 of the bottom body 122. By extending the elongated receiver 102 to the bottom wall 134, cantilevered support for the umbrella pole is increased. At the bottom cavity 168, the bottom side wall 136 of the bottom body 122 covers the slots 132 of the side wall 120 of the top body 124 so as to enclose the bottom cavity 168.

Figure 7:
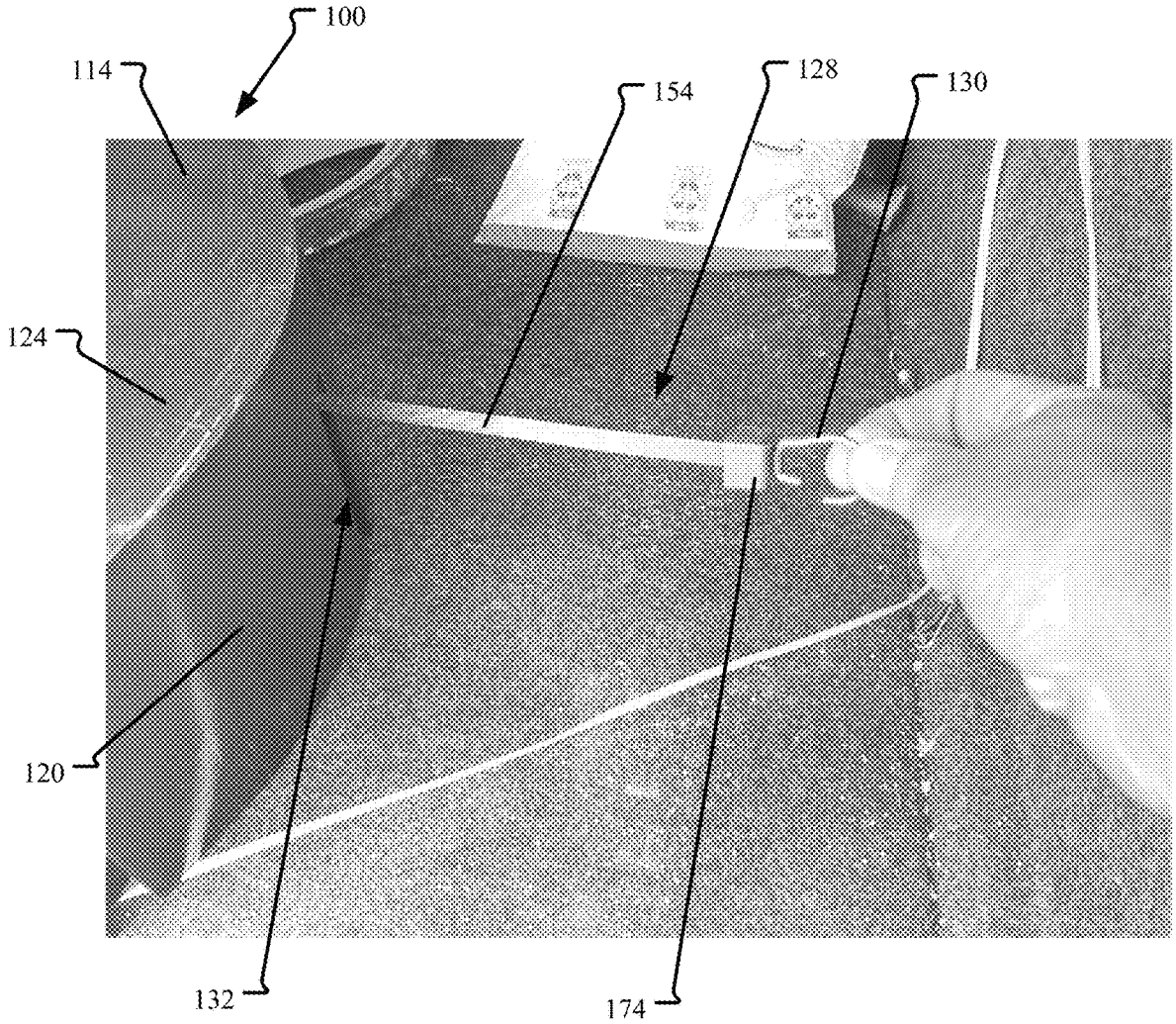
FIG. 7 is a partial perspective view of the umbrella base in an extended configuration.
Figure 8:
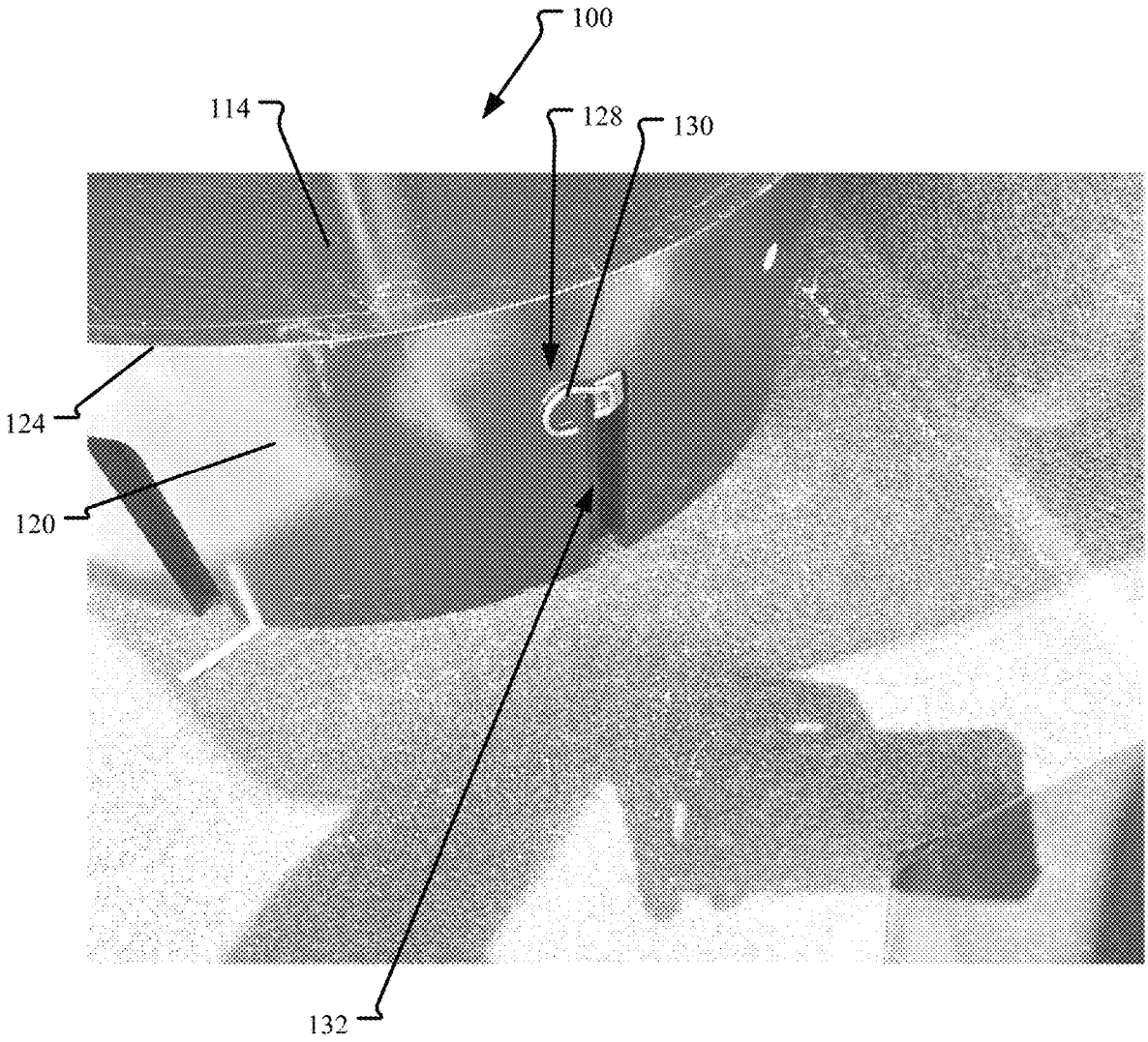
FIG. 8 is a partial perspective view of the umbrella base in a retracted configuration.

FIG. 7 is a partial perspective view of the umbrella base 100 in an extended configuration. FIG. 8 is a partial perspective view of the umbrella base 100 in a retracted configuration. Starting first with FIG. 7, the retention system 128 is illustrated in an extended configuration. That is, the retractable strap 154 is in an extended configuration with the fastener device 130 being disposed apart from the housing 114. In the extended configuration, the fastener device 130 can be attached to the outdoor furniture so that the umbrella base 100 is utilized to hold down the outdoor furniture in windy conditions. The retractable strap 154 extends and retracts from the housing 114 via the slots 132 within the side wall 120 and are flexible so that it is easier to attach the fastener device 130 to a variety of locations on the outdoor furniture. This flexibility of the retractable straps 154 can be in the left or right direction or the up and down direction as required or desired. The extension length of the retractable straps 154 (e.g., a distance that the fastener device 130 is positioned away from the housing 114) is based on the overall length of the strap and the location of the outdoor furniture. In the example, the slots 132 of the top body 124 are aligned with the slots of the bottom body (not shown).

A stop shoulder 174 is disposed at the proximate end of the fastener device 130 and is configured to prevent the fastener device 130 from fully retracting into the housing 114. The stop shoulder 174 is shaped and sized to be received at least partially within the slot 132 and position the fastener device 130 at the side wall 120 of the housing 114 as illustrated in FIG. 8. As such, users can more easily reach the fastener device 130 when attaching it to the outdoor furniture.

Turning to FIG. 8, the umbrella base 100 typically houses the retractable straps 154 (shown in FIG. 7) in a retracted configuration so that the fastener devices 130 are positioned against the side wall 120. In an aspect, one or more recesses may be defined on the side wall 120 by the slots 132 and bottom body configuration to further capture the fastener devices 130. Because the umbrella base 100 also supports an umbrella as required or desired and typically around outdoor furniture (e.g., table and/or chairs). This configuration keeps the fastener devices 130 out of the way so as to reduce people catching their feet on the fastener devices 130 when using the outdoor furniture.

In the retracted configuration, the fastener device 130 may be positioned against the housing 114 and by the slots 132 of the top body 124. In the example, the fastener device 130 is pivotable relative to the free end of each of the straps so that the fastener device 130 can lay substantially flat against the side wall 120. While the retention system 128 is illustrated as being a component of an umbrella base 100, it should be appreciated that the retention system 128 can be used with any other weighted structure so as to retain outdoor furniture. For example, the retention system 128 can be part of an outdoor storage container, an outdoor table, an outdoor cabinet, or the like.

In operation, the housing 114 is used to support the umbrella in its upright orientation. Once the outdoor furniture that surrounds the umbrella base 100 is no longer in use and to reduce or prevent the furniture from blowing away in the wind, the fastener devices 130 can be extended from the umbrella base 100 and attached to the adjacent outdoor furniture. By attaching the outdoor furniture to the umbrella base 100, the outdoor furniture is weighed down against the wind. The fastener devices 130 can be used regardless of the umbrella being supported by the umbrella base 100. By utilizing the umbrella base 100 as a hold down device, additional components of an outdoor furniture set are no longer needed and do not need to be separately stored when no longer in use. For example, dedicated ties downs attached to the underlying surface or a plurality of bungee cords. Additionally, the umbrella base 100 can be moved and repositioned as required or desired.

Figure 9:
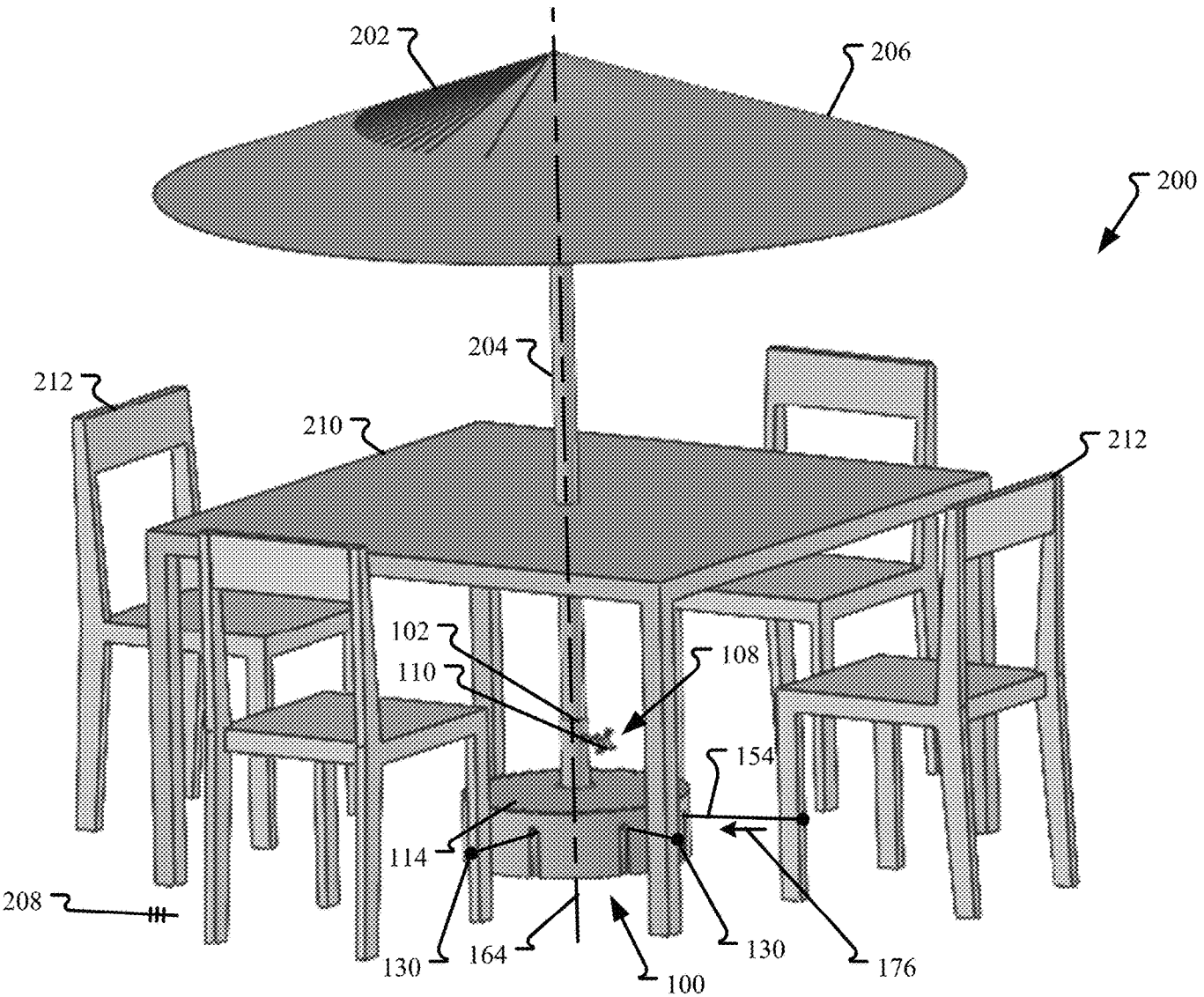
FIG. 9 is a perspective view of the umbrella base in use with outdoor furniture.

FIG. 9 is a perspective view of the umbrella base 100 in use with outdoor furniture 200. The umbrella base 100 includes the elongated receiver 102 that defines the longitudinal axis 164. The elongated receiver 102 is configured to partially receive an umbrella 202, and more specifically, receive a pole 204 of the umbrella 202 so as to support the umbrella 202 along the longitudinal axis 164 and position a canopy 206 above an underlying surface 208, such as, a patio or a deck. The housing 114 is positioned on the underlying surface 208 via the bottom surface. The bottom surface is spaced from the top surface of the housing along the longitudinal axis 164, with the side wall of the housing being parallel to the longitudinal axis 164. The retractable straps 154 are configured to extend and retract radially from the longitudinal axis 164 such that the fastener device 130 can attach to the outdoor furniture 200. As illustrated in FIG. 9, the umbrella base 100 is positioned underneath a table 210 and the fastener devices 130 are attached to chairs 212 and the table 210. In this configuration, the chairs 212 and the table 210 are weighted down for windy conditions by the umbrella base 100 so that they will not blow away. It should be appreciated that the umbrella 202 does not need to be supported by the umbrella base 100 in order to attach the chairs 212 and table 210 thereto. Additionally, outdoor furniture 200 can include other types of furniture as required or desired. The outdoor furniture 200 need not include specific attachment points, as the fastener device 130 is shaped and sized to attach to multiple different locations on the frame.

The retractable straps 154 are circumferentially spaced around the longitudinal axis 164 so that outdoor furniture 200 may be attached from any direction relative to the umbrella base 100. The retractable straps 154 also extend radially relative to the longitudinal axis 164. As such, a radial retention force 176 is being applied via the retractable strap 154 so as to hold the outdoor furniture 200 towards the umbrella base 100 and restrict the outdoor furniture from moving along the underlying surface 208 in windy conditions. The fastener device 130 is disposed above the underlying surface 208 and attaches to the outdoor furniture 200 at a location above the underlying surface 208 so as to reduce the outdoor furniture 200 from tipping over in windy conditions. By using the umbrella base 100 to hold down outdoor furniture 200 in windy conditions, loose tie downs like bungee straps do not need to be used and which can get easily lost. Additionally, extra weighted components are not needed for the outdoor furniture 200.

In the example, the retention system is disposed at least partially with a cavity formed by the multi-piece housing 114. This construction reduces dirt and debris from accumulating at the retention system. In other examples, the bottom surface may include a cavity formed therein that is configured to house the retention system closer to the underlying surface 208 and as described herein.

Figure 10:
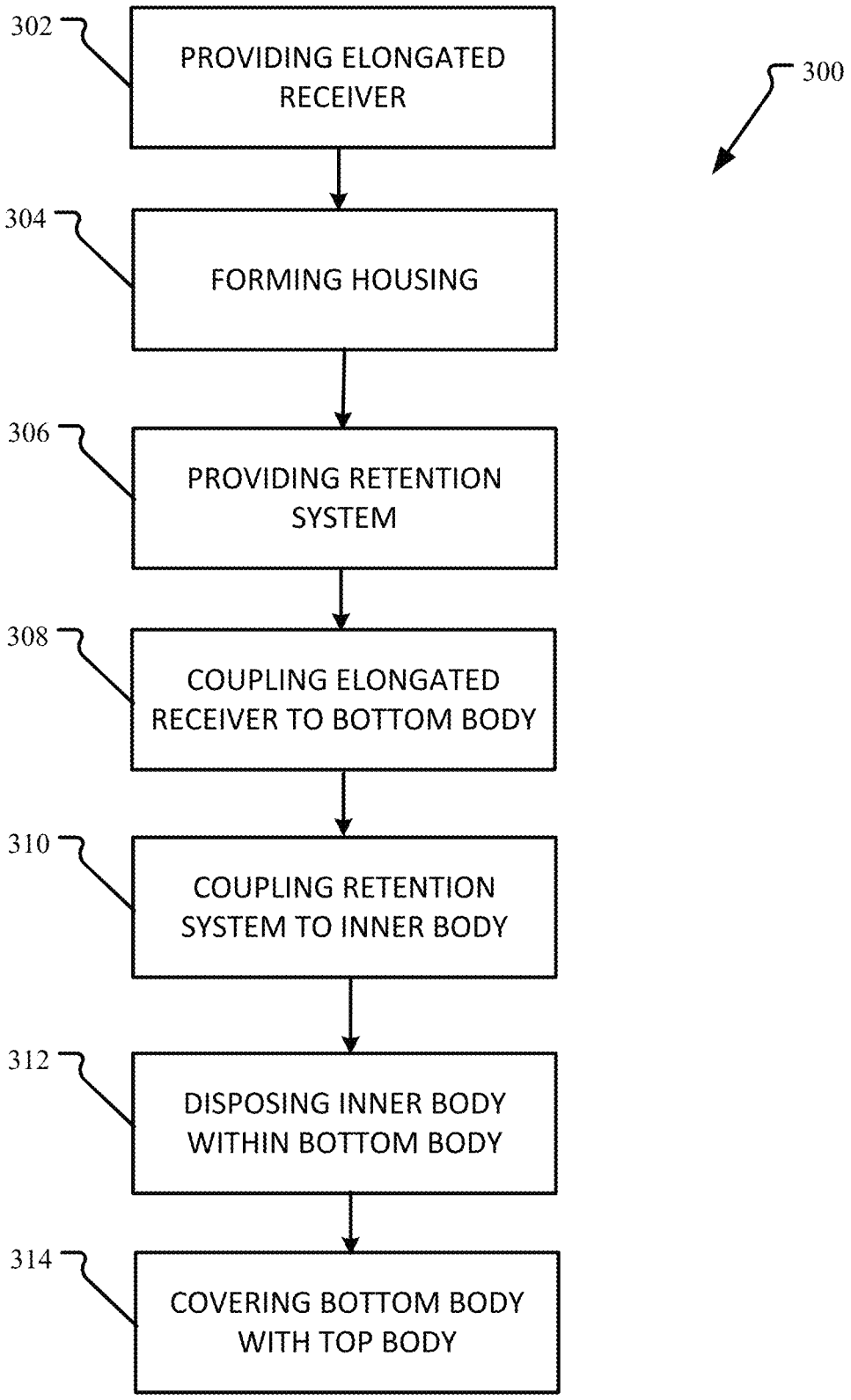
FIG. 10 illustrates a flowchart of an exemplary method of assembling an umbrella base.

FIG. 10 illustrates a flowchart of an exemplary method 300 of assembling an umbrella base. The example methods and operations can be implemented or performed by the systems and devices described herein (e.g., umbrella base 100). The method 300 begins with providing an elongated receiver configured to at least partially receive an end of a pole of an umbrella (operation 302). A housing is formed (operation 304). In an aspect, the housing includes a bottom body defined a bottom surface configured to be placed directly on an underlying surface, a top body defining a top surface and a side wall, and an inner body. Additionally, a retention system is provided (operation 306). In an aspect, the retention system includes a plurality of fastener devices adapted to selective and retractably extend.

The elongated receiver is coupled to the bottom body (operation 308). For example, one end of the elongated receiver is coupled to a bottom wall of the bottom body via a threaded collar. Additionally, the retention system is coupled to the inner body (operation 310). The inner body is then disposed within an interior cavity at least partially formed by the bottom body (operation 312), and the bottom body is covered by the top body (operation 314). When the bottom body is covered by the top bottom, the elongated receiver at least partially extends from the top surface of the top body and the plurality of fastener devices are disposed on an exterior of the side wall. In some examples, the method may further include disposing one or more weights between the inner body and the bottom body.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While various embodiments have been described for purposes of this disclosure, various changes and modifications may readily suggest themselves to those skilled in the art and may be made which are well within the scope of the present disclosure.

What is claimed is:

1. An umbrella base comprising:

an elongated receiver configured to at least partially receive an end of a pole of an umbrella;

a housing including:

a bottom body defining a bottom surface configured to be placed directly on an underlying surface;

a top body defining a top surface and a side wall, the side wall extending between the top and bottom surfaces at least partially over the bottom body; and an inner body received at least partially within an interior cavity formed by the bottom body and the top body; and a retention system coupled to the inner body, the retention system including a plurality of fastener devices positioned at least partially exterior of the side wall, the plurality of fastener devices adapted to selectively and retractably extend outwards from the side wall and configured to releasably attach to outdoor furniture, wherein the retention system includes a plurality of retractable straps coupled to the corresponding fastener devices, each strap of the plurality of retractable straps having a case coupled to the inner body.

2. The umbrella base of claim 1, wherein the inner body has a bottom wall, the bottom wall dividing the interior cavity of the housing into a top cavity and a bottom cavity, the retention system disposed within the top cavity, and one or more weights are disposed within the bottom cavity.

3. The umbrella base of claim 2, wherein the one or more weights comprise at least one of sand, water, or weighted plates.

4. The umbrella base of claim 1, wherein the bottom body includes one or more interior struts supporting the inner body within the bottom body.

5. The umbrella base of claim 1, wherein each of the bottom body, the top body, and the inner body have slots allowing at least a portion of the retention system to extend through the side wall of the housing.

6. The umbrella base of claim 1, further comprising a collar fixed to the bottom body, the collar threadably coupled to an end of the elongated receiver.

7. The umbrella base of claim 1, wherein the retention system is disposed in a top half of the housing.

8. An outdoor furniture retention assembly comprising:

an elongated receiver configured to receive a pole of an umbrella, the elongated receiver defining a longitudinal axis;

a housing at least partially surrounding the elongated receiver, the housing including a bottom surface and an opposite top surface, the bottom surface and the top surface spaced apart along the longitudinal axis, the housing also including a side wall extending between the bottom surface and the top surface parallel to the longitudinal axis, the side wall having a greater diameter than the elongated receiver, wherein a plurality of slots are defined in the side wall and circumferentially spaced around the longitudinal axis; and a retention system supported by the housing, the retention system including:

a plurality of fastener devices positioned at least partially exterior of the side wall and each fastener device corresponding to each of the plurality of slots, the plurality of fastener devices adapted to selectively and retractably extend outwards from the side wall and configured to releasably attach to outdoor furniture; and a plurality of retractable straps coupled to the corresponding fastener devices, each strap of the plurality of retractable straps having a case coupled within the housing.

9. The outdoor furniture retention assembly of claim 8, wherein the housing includes at least a top body and a bottom body, the bottom body and the top body defining an interior cavity configured to hold the cases of the plurality of retractable straps.

10. The outdoor furniture retention assembly of claim 8, wherein each fastener device is pivotable relative to the free end of each of the plurality of retractable straps.

11. The outdoor furniture retention assembly of claim 8, further including a securement device supported on the elongated receiver for securing the pole of the umbrella.

12. The outdoor furniture retention assembly of claim 8, wherein each fastener device automatically retracts towards the housing upon release from the outdoor furniture.

13. The outdoor furniture retention assembly of claim 8, wherein the plurality of retractable straps radially extend and retract relative to the longitudinal axis.

* * * * *